US006708855B2

(12) United States Patent
Wilson et al.

(10) Patent No.: US 6,708,855 B2
(45) Date of Patent: Mar. 23, 2004

(54) TRANSVERSE FOLDING APPARATUS

(76) Inventors: Robert W. Wilson, 2871 Mayflower Rd., Green Bay, WI (US) 54311; Gary E. Johnson, 1561 Waterford Ct., Green Bay, WI (US) 54313; Kenneth A. Krausert, 1323 Cormier Rd., Green Bay, WI (US) 54313; John H. Wunderlich, 2880 Madrid Dr., Green Bay, WI (US) 54311; Thomas Huempfner, 1871 Susie Dr., Suamico, WI (US) 54173

( * ) Notice: Subject to any disclaimer, the term of this patent is extended or adjusted under 35 U.S.C. 154(b) by 0 days.

(21) Appl. No.: 10/115,518

(22) Filed: Apr. 3, 2002

(65) Prior Publication Data

US 2003/0189069 A1 Oct. 9, 2003

(51) Int. Cl.[7] ..... A41H 33/00
(52) U.S. Cl. ..... 223/37; 223/38
(58) Field of Search ..... 223/37, 38; 493/416

(56) References Cited

U.S. PATENT DOCUMENTS

| | | | | |
|---|---|---|---|---|
| 968,709 | A | 8/1910 | Spalckhaver | |
| 1,566,079 | A | 12/1925 | Christman, Jr. et al. | |
| 2,019,658 | A | 11/1935 | Crafts | |
| 3,489,406 | A | 1/1970 | Nystrand | |
| 3,498,600 | A | 3/1970 | Spencer et al. | |
| 3,689,061 | A | 9/1972 | Nystrand | |
| 3,762,697 | A | 10/1973 | Bolza-Schunemann | |
| 3,870,292 | A | 3/1975 | Bradley | |
| 4,190,242 | A | 2/1980 | Bolza-Schunemann | |
| 4,349,185 | A | 9/1982 | Small et al. | |
| 4,521,209 | A | 6/1985 | DuFresne | |
| 4,625,957 | A | 12/1986 | DuFresne | |
| 4,682,977 | A | 7/1987 | Buxton | |
| 4,824,426 | A | 4/1989 | DuFresne | |
| 5,328,323 | A | 7/1994 | Molison | |
| 5,363,728 | A | 11/1994 | Elsner | |
| 5,368,540 | A | 11/1994 | Saab | |
| 5,634,875 | A | 6/1997 | Risk et al. | |
| 5,795,433 | A | 8/1998 | Niedermeyer | |
| 5,904,277 | A | 5/1999 | Niedermeyer | |
| 5,970,833 | A | 10/1999 | Molison | |
| 6,055,896 | A | 5/2000 | Molison | |
| 6,375,605 | B1 * | 4/2002 | Niedermeyer | 493/359 |
| 6,440,053 | B1 * | 8/2002 | Niedermeyer | 493/416 |

FOREIGN PATENT DOCUMENTS

EP 0 891 938 B1 10/2001

OTHER PUBLICATIONS

Paper Converting Machine Company Drawing 007006–11–00–00 for Job 7006 Folder, Mar. 11, 1987.
Paper Converting Machine Company Drawing 6028707–623, dated 1987.
Specifications for Job 7006, dated Dec. 2, 1986.

* cited by examiner

*Primary Examiner*—Rodney M. Lindsey
*Assistant Examiner*—James G Smith

(57) ABSTRACT

A transverse folding apparatus for folding cut web products into web wipes, napkins, and the like includes a tucker blade which follows a hypocycloidal path for folding the web products. A cutoff roll and an anvil roll cut a web into cut web products. The cut web products are conveyed along a first web path by first and second belts. The second belt also extends along a second web path which extends transversely from the first web path. The first belt extends along the first web path beyond the second web path. The tucker blade moves transversely past the first belt into the first web path to engage each web product and transversely fold the web product into the second web path. A creasing roll along the second web path engages the folded edge of each web product. A pair of stacker infeed belts extend along the second web path and convey the web produts from the second belt to a stacker.

18 Claims, 13 Drawing Sheets

TRANSVERSE FOLDING APPARATUS

BACKGROUND AND SUMMARY OF INVENTION

This invention relates to an apparatus and method for the transverse folding of webs such as those made into wet wipes, napkins, hankies, or the like. Representative showings of the prior art can be seen in co-owned U.S. Pat. Nos. 1,566,079, 3,489,406, 3,498,600, 3,689,061, 3,870,292, 4,349,185, 4,625,957, 4,682,997, and 4,824,426, and other U.S. Pat. Nos. 5,211,320, 5,795,433, 5,904,277.

The process of producing stacks of transverse folded product usually requires vacuum rolls to hold, transfer, and fold the product. The prior art devices which used vacuum rolls were limited in speed as the vacuum had to be turned on and off at critical times. The vacuum systems are very expensive to manufacture, have very high maintenance costs and downtime, and are often limited in speed as the vacuum system plugs. When wet product is folded, wetting solutions are extracted from the web, which is undesirable and costly. The extracted solutions are difficult to recycle and increase waste.

The prior art vacuum and cutoff rolls were also limited in the products they could run. Cutoff sizes were set by the roll diameters, and running multiple cut lengths required significant change-over of parts and time.

It is desirable to provide a machine which can operate more products and cost less to operate with less waste.

U.S. Pat. No. 3,762,697 describes a folder for a web-fed rotary press. The folder includes folding blade cylinders which include tucking devices which travel in a hypocycloidal path as the cylinders rotate.

U.S. Pat. No. 4,190,242 also describes a tucking device which travels in a hypocycloidal path within a gripping-cylinder. The gripping cylinder includes pins for holding product on the cylinder.

U.S. Pat. No. 5,368,540 describes a hypocycloidal folding device which includes a folding cylinder which carries folding jaws which follow a hypocycloidal path.

The assignee of this invention has sold machines for folding wrapping paper and machines for folding diapers which utilized tuckers which travelled in a hypocycloidal path. However, such machines were not suitable for folding wet wipes and were set up for folding only one product length. The machines were not readily adjustable for folding products of varying lengths.

When the machine for folding wrapping paper was used for folding wet products, the wet produts, and even some dry non-woven products, would stick to the cutoff blades and not drop downwardly. The product also tended to stick to the vertical belts which conveyed the product to the tucker. The product would sometimes follow the belts into the tucking nip and would not be folded.

SUMMARY OF THE INVENTION

The invention provides a transverse folding apparatus which is particularly suitable for wet wipes and which eliminates vacuum rolls. The elimination of vacuum systems reduces costs and avoids the limitations of the prior art vacuum systems.

The apparatus uses a pinch cutoff to cut individual product to the desired length, a vertical belt feed system, a horizontal belt system, a hypocycloidal motion tucker for folding the product, and a stacker. The cutoff and anvil rolls include corrugated comb shells which pull the product off of the rolls. One of the sets of vertical belts extends beyond the tucker so that the leading end of the product was conveyed past the tucker. The tucker is notched so that it did not contact the belts.

The hypocycloidal tucker can be used with an infinite range of product lengths, and a variable speed cutoff system varies the product length as desired within a wide range of product sizes.

DESCRIPTION OF THE DRAWING

The invention will be explained in conjunction with illustrative embodiments shown in the accompanying drawing, in which.

DESCRIPTION OF SPECIFIC EMBODIMENT

Figure 1:
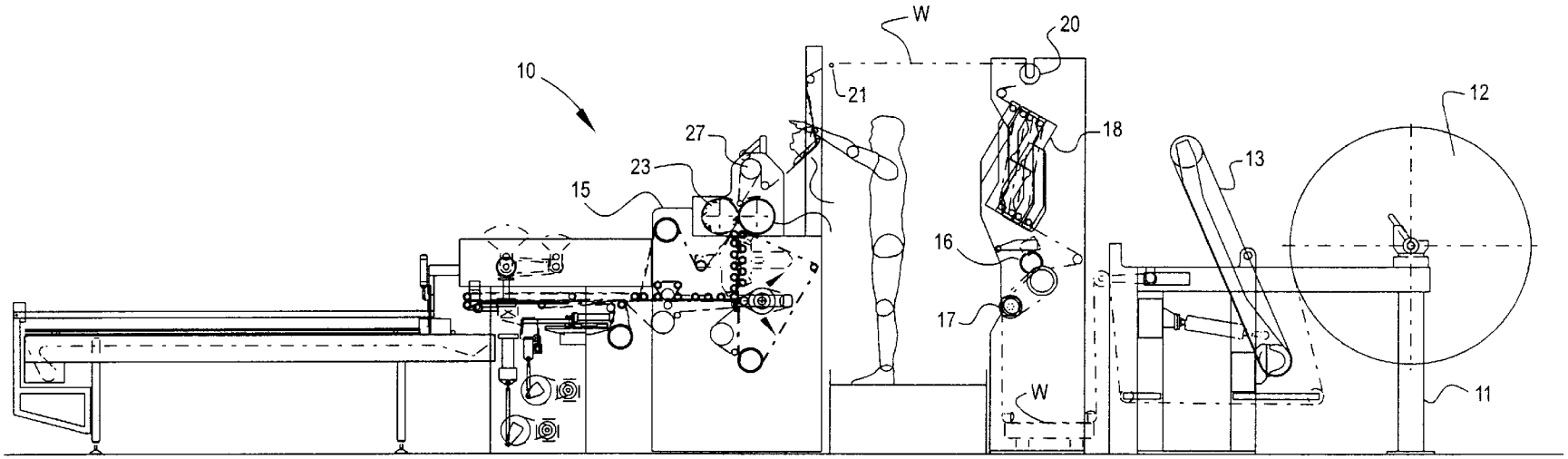
FIG. 1 is a side view of a transverse folding apparatus in accordance with the invention.

Referring to FIG. 1, a web W is fed to transverse folding apparatus 10 from an unwind stand 11. The unwind stand rotatably supports a parent roll 12 of web material. The web material can be material suitable for producing wet wipes, napkins, hankies, or the like. The particular unwind stand illustrated includes a belt drive 13 for rotating the parent roll and unwinding the web. The unwind can be a single position unwind or a turret style or side shifting style which allows a new parent roll to be held in a standby position.

The folding apparatus includes a frame 15 which supports the components of the apparatus. The web W travels from the unwind through a slitter 16 upstream of the folding apparatus. The slitter slits the web into multiple webs of the desired width. For example, the web can be slit into four webs which are processed together. Other web widths and multiples of slits are possible. A driven bowed roll 17 spreads the web and reduces possible wrinkles prior to the slitter.

The slit webs are slightly separated by conventional web separation bars 18. For example, the separation bars can align the slit webs on ten inch center to center spacing for processing throughout the rest of the machine.

A vector driven draw roll 20 controls the tension of the webs for folding.

If the folding apparatus is used for folding wet product, the slit webs are moistened or wetted with the correct amount of lotion or fluid by a wicking type wetting tube 21.

Figure 3:
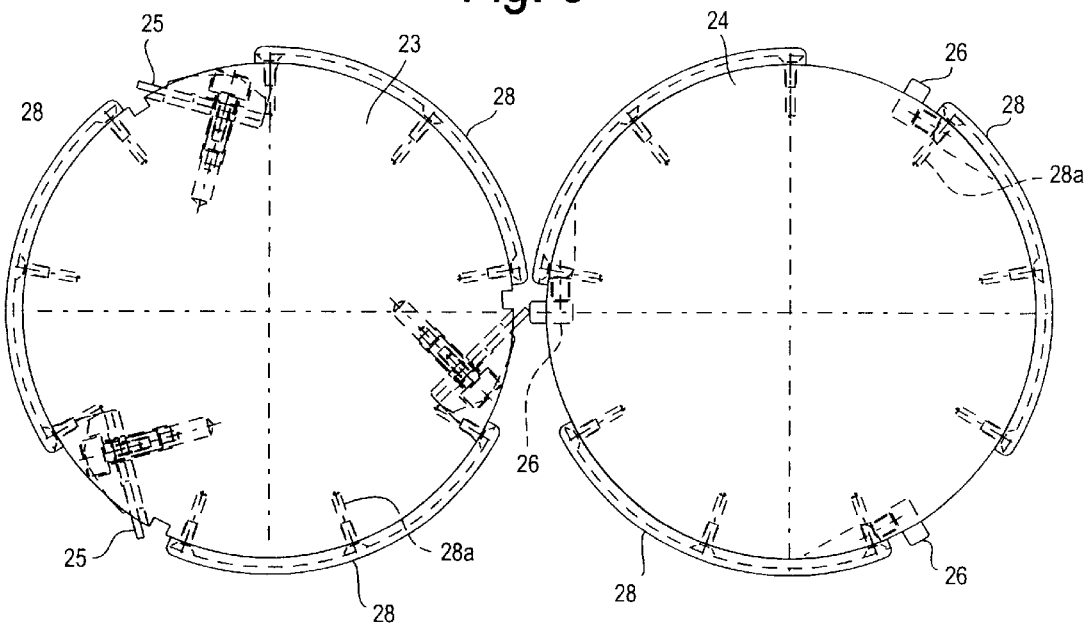
FIG. 3 is an enlarged side-view of the cutoff and anvil rolls.

A cutoff roll 23 and an anvil roll 24 are rotatably mounted on the frame 15 and are driven by a suitable drive, for example, a servo motor. In the embodiment illustrated three cutoff knives 25 (FIG. 3) are mounted on the cutoff roll and provide a flex pinch cut against pads 26 on the anvil roll. In one specific embodiment the three knives were spaced at 120° on a 9.5 inch surface pitch to provide a cut range of approximately 6 to 8.7 inches. Different diameter cutoff rolls can be used with one, two, three or more cutoff knives.

Referring again to FIG. 2, a feed roll 27 is mounted above the cutoff assembly and is mechanically driven from the cutoff rolls by a variable speed belt or by a separate motorized drive. The feed roll meters the proper amount of folded web from the folding plates 22 to be cut by the cutoff rolls. Feeding the folded web faster than the cutoff rolls produces longer product. Feeding the folded web slower than the cutoff rolls produces shorter product.

The webs enter the cutoff rolls vertically to aid the moistened webs in entrance and exit transfers. Downward vertical discharge from the cutoff rolls assists in advancing the web product with a gravity feed. Discharging wet limp product would be more difficult if the discharge was more toward horizontal.

In the preferred embodiment the feed roll 27 is speed changed to control product length, and vertical belts below the cutoff rolls run at the same speed as the cutoff roll. In an alternate method the vertical belts can run at the same speed as the feed roll.

The slit webs then travel through conventional folding plates 22 for making one or more longitudinal folds in each web. Typical folds for this type of machine include "C", "Z", and "V" folds, or variations of those basic styles. Other fold configurations may be provided with some possible alternations to the web path.

Figure 4:
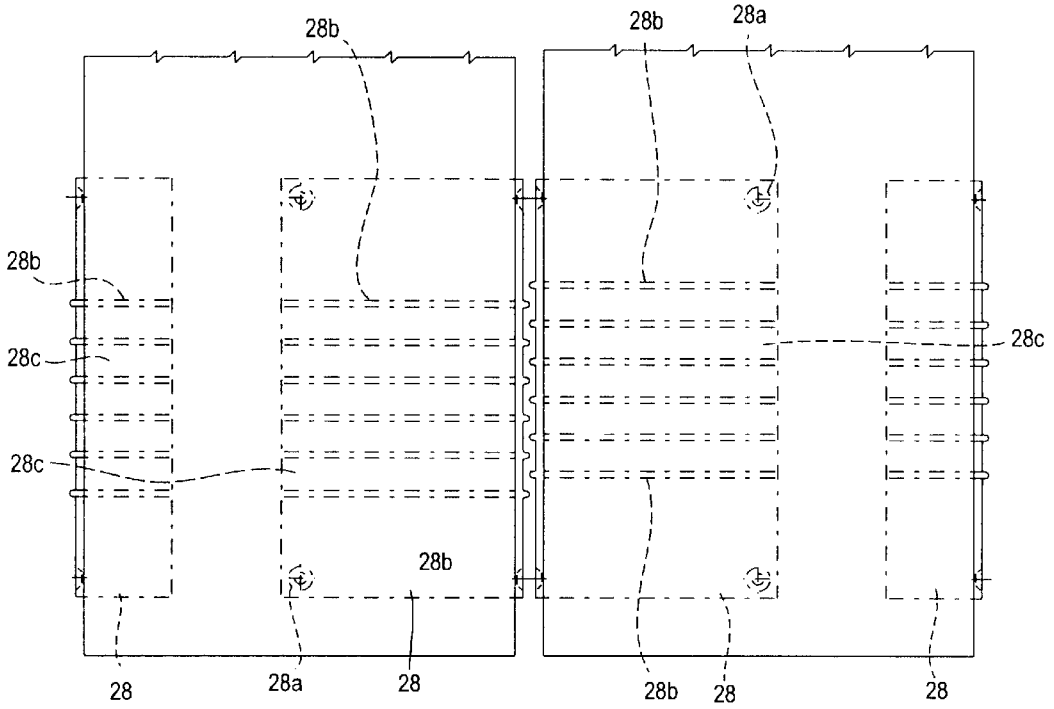
FIG. 4 is a top plan view of the cutoff and anvil rolls.
Figure 4A:
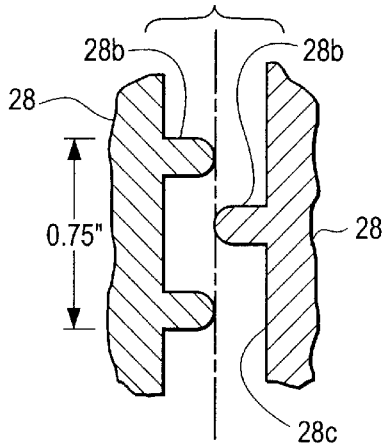
FIGS. 4A through 4C are sectional views through comb shells on the cutoff and anvil rolls showing various spacings and positions of the ridges on the shells.
Figure 4B:
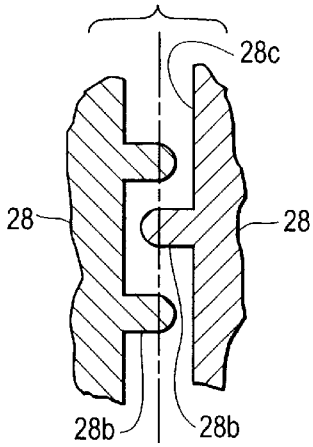
Figure 4C:
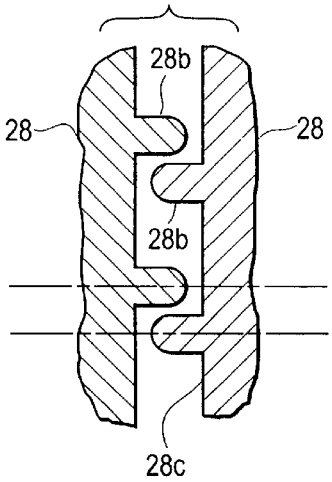
Figure 5A:
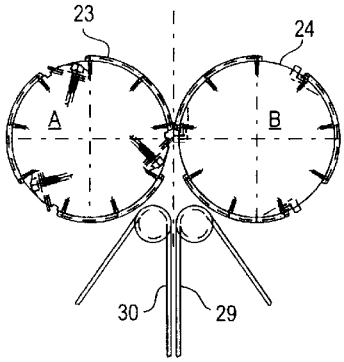
FIGS. 5A through 5I illustrate the cutoff cycle in 15° increments.
Figure 5B:
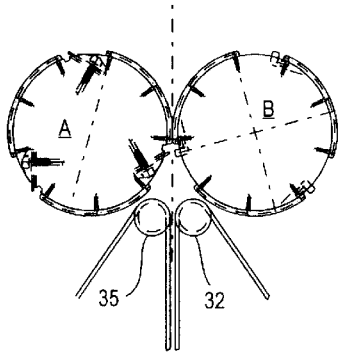
Figure 5C:
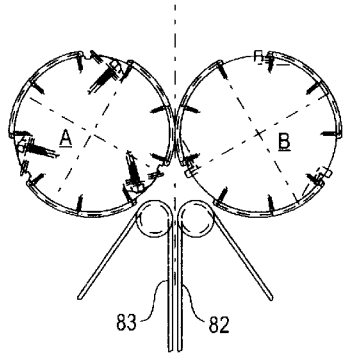
Figure 5D:
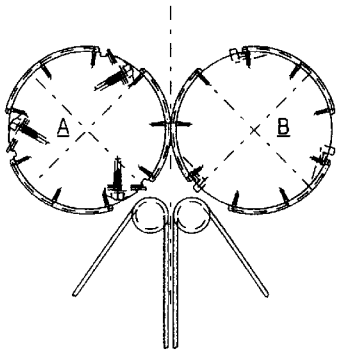
Figure 5E:
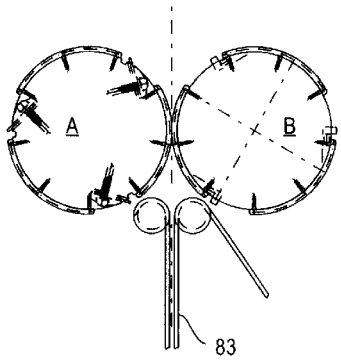
Figure 5F:
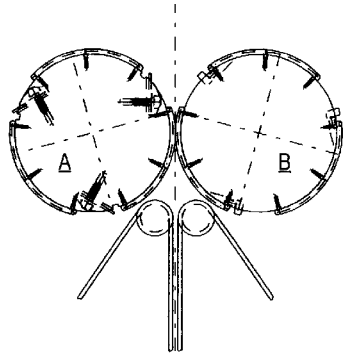
Figure 5G:
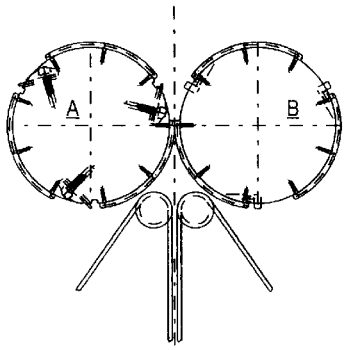
Figure 5H:
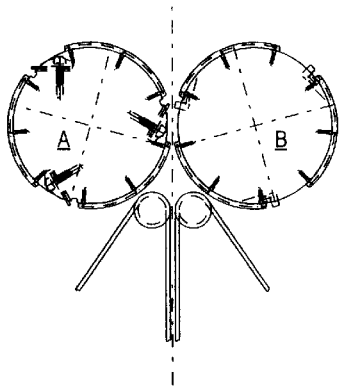
Figure 5I:
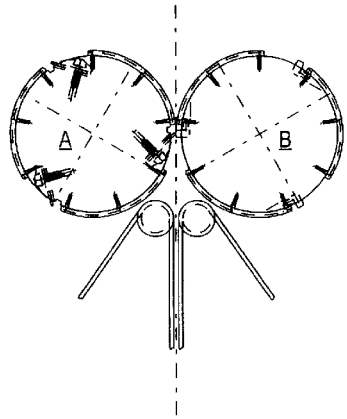

The cutoff roll 23 and anvil roll 24 are provided with comb shells 28 (FIGS. 3 and 4) which are retained on the rolls by screws 28*a*. Each roll includes three curved shells. Each shell has a corrugated outer surface which is provided by radially outwardly extending ridges 28*b*. The ridges on each of the cutoff roll and anvil roll are positioned facing the valleys 28*c* between adjacent ridges on the other roll. The tips of the extended ridges are inline with opposing tips in the preferred embodiment, i.e., the tips of both shells lie in the same plane as can be seen in FIG. 4A. The tips may also be deeper and into the opposing valley (FIG. 4B), and may be located closer to each other (FIG. 4C). The preferred embodiment has the ridges spaced about 0.75 inch apart. Other spacings or shapes would also work.

As the product moves between the cutoff and anvil rolls, the corrugated comb shells grip and slightly squeeze the product. The corrugations pull the product off of the cutoff blades and anvils with a two-part force—one force slightly narrows the product and one force slightly lifts the product off of the blades and anvils so that the product moves vertically downwardly after being cut. FIGS. 5A–5I illustrate the vertical movement of the product through the nip between the cutoff roll and anvil roll in 15° increments of the rotation of the cutoff and anvil rolls. The corrugations also stiffen the product, which reduces wrinkling and cross direction skew, while also helping to hold the panels of the fold together and to deliver the product to the vertical belts.

Opposed sets of V-belts 29 and 30 transfer the cut-to-length folded web downwardly toward a cross folder assembly 31. Each of the right and left sets 29 and 30 of V-belts includes a pair of V-belts for each lane of cut-to-length folded webs, for example, four lanes. The right and left V-belts grip each folded web inwardly of the side edges of the folded web.

The right hand set 29 of V-belts travels vertically downwardly from the cutoff rolls over five vertically spaced rollers 32, past the cross folder assembly 31, around a driven roller 33, upwardly around a roller 34, and back to the top roller 32.

The left hand set 30 of the V-belts travels vertically downwardly over an upper change part roller 35, over five idler rollers 36, and over a bottom change part roller 37. The belts turn to the left after the bottom roller 37. The left V-belts then travel horizontally under four horizontally spaced rollers 44, are diverted over two rollers 39 and 40, travel horizontally over rollers 41 and 42, upwardly over driven roller 43, downwardly over pivotable roller 44, and upwardly to the top roller 35.

A 5.5 inch wide flat belt 46 travels horizontally below the horizontally spaced rollers 38, 41, and 42 for each lane of product. The belts 46 travel horizontally between rollers 47 and 48 and downwardly over driven roller 49. The width of each of the belts 46 is sufficient to extend across the width of the cut-to-length products.

A 5.5 inch wide flat belt 51 travels vertically below and in alignment with the vertical position of the left set of V-belts 30 for each lane of product. The belts 51 travel vertically downwardly between rollers 52 and 53 and upwardly over driven roller 54.

Figure 6:
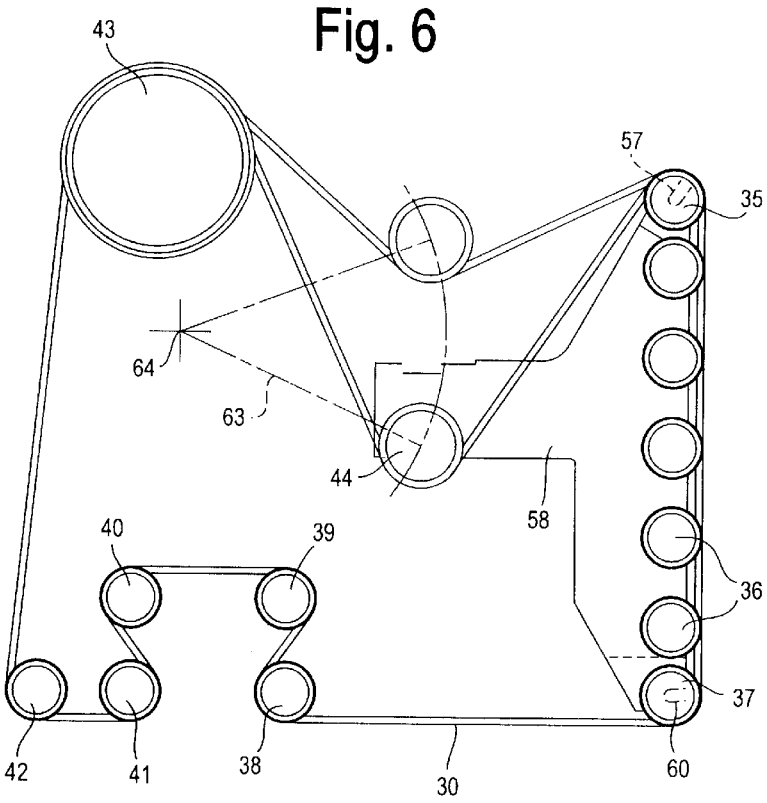
FIG. 6 illustrates the inside belt which travels both vertically and horizontally.
Figure 7:
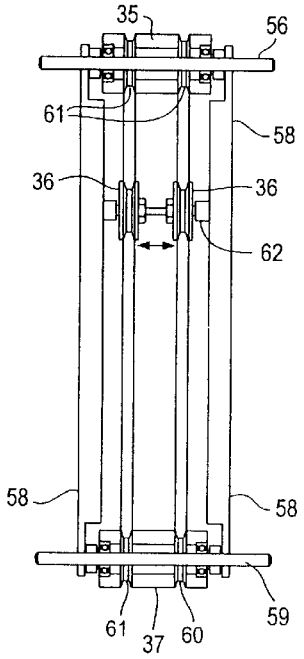
FIG. 7 is a fragmentary side view of FIG. 6.

Referring to FIGS. 6 and 7, the upper change part roller 35 rotates on a shaft 56 which is mounted in slots 57 in spaced-apart vertical belt frames 58. The lower change part roller 37 is similarly mounted on a shaft 59 which is inserted in slots 60 in the belt frames 58. Each of the change part rollers 35 and 37 is provided with a pair of grooves 61 for the two V-belts which engage each lane of product. The idler rollers 36 are mounted on shafts 62 which are supported by the frames 58. Each idler roller engages a single V-belt.

The change part rollers 35 and 37 are retained in the slots 57 and 60 in the frames by the tension of the V-belts 30. Tension on the belts is controlled by pivoting roller 44, which is mounted on an arm 63 which pivots about pivot axis 64. When the product width is changed, the belts 30 are loosened by pivoting the roller 44 upwardly so that the change part rollers 35 and 37 can be removed from the frames and replaced by change part rollers which have a different spacing between the grooves 61. The idler rollers 36 are slidably mounted on the shafts 62 and are moved into alignment with the grooves 61. The pivoting roller 44 is then pivoted downwardly to tighten the belts 30 around the change part rollers 35 and 37 and the idler rollers 36.

Figure 8:
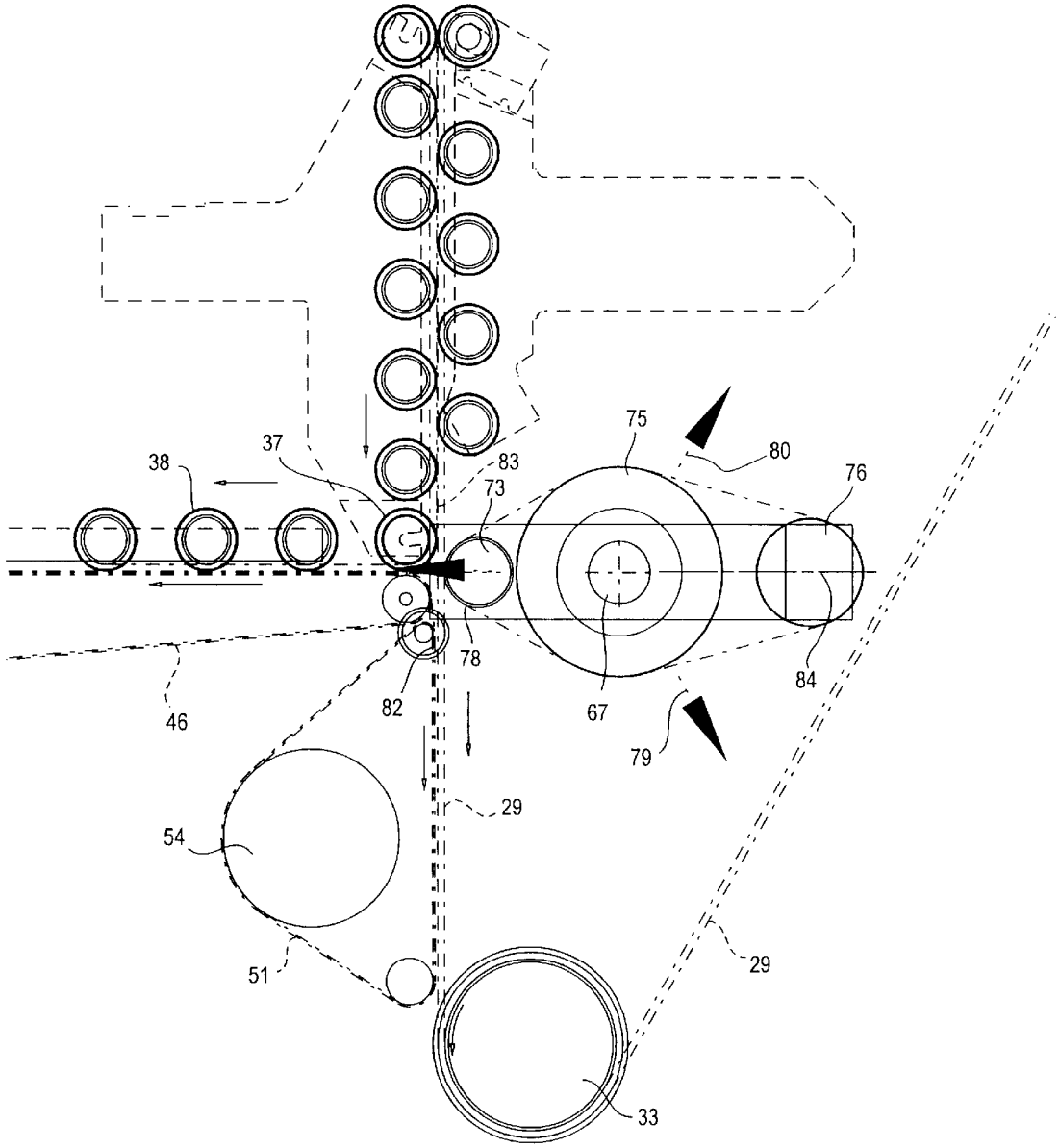
FIG. 8 illustrates the vertical belts below the hypocycloidal tucker.
Figure 9:
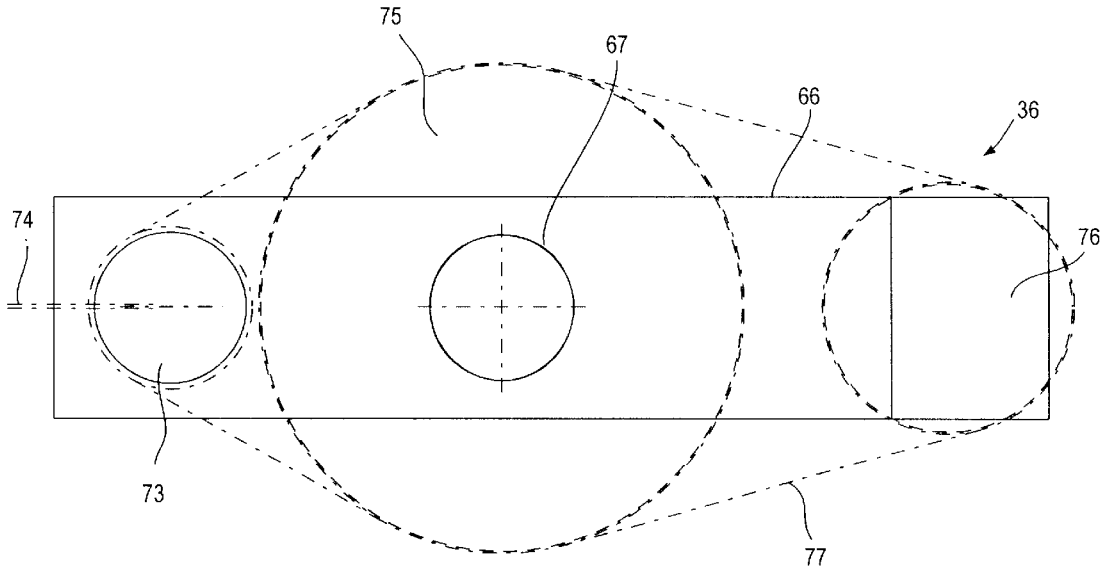
FIG. 9 is a side view of the hypocycloidal tucker.
Figure 12:
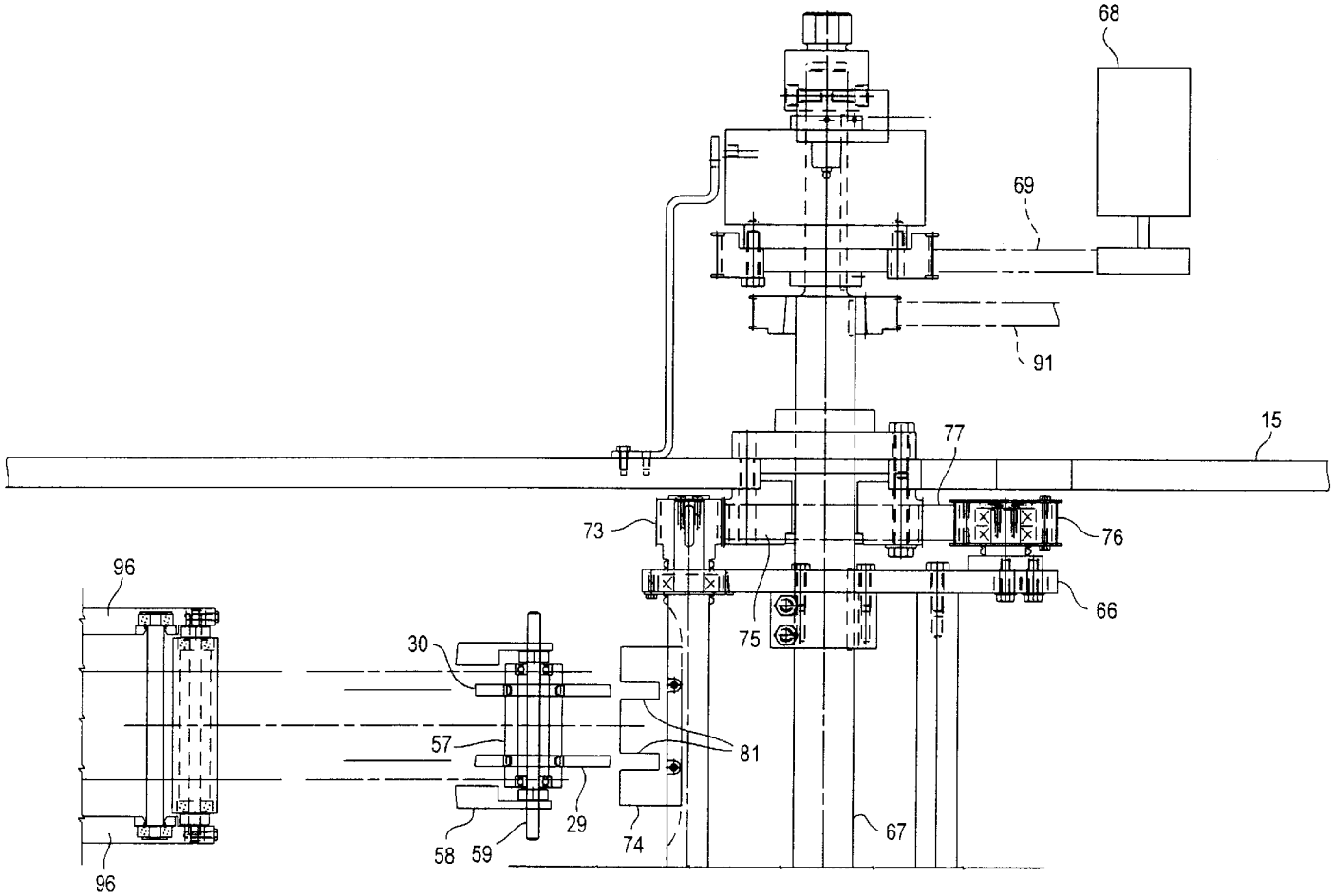
FIG. 12 is a fragmentary top plan view of the tucker and one set of vertical belts.

Referring to FIGS. 8, 9, and 12, the cross folder or tucker assembly 31 includes a pair of rotary arms 66 which are mounted on a rotary shaft 67. The shaft 67 is rotatably mounted on the frame 15 and is driven by motor 68 (FIG. 12), which may be a servo, and a belt 69.

Figure 13:
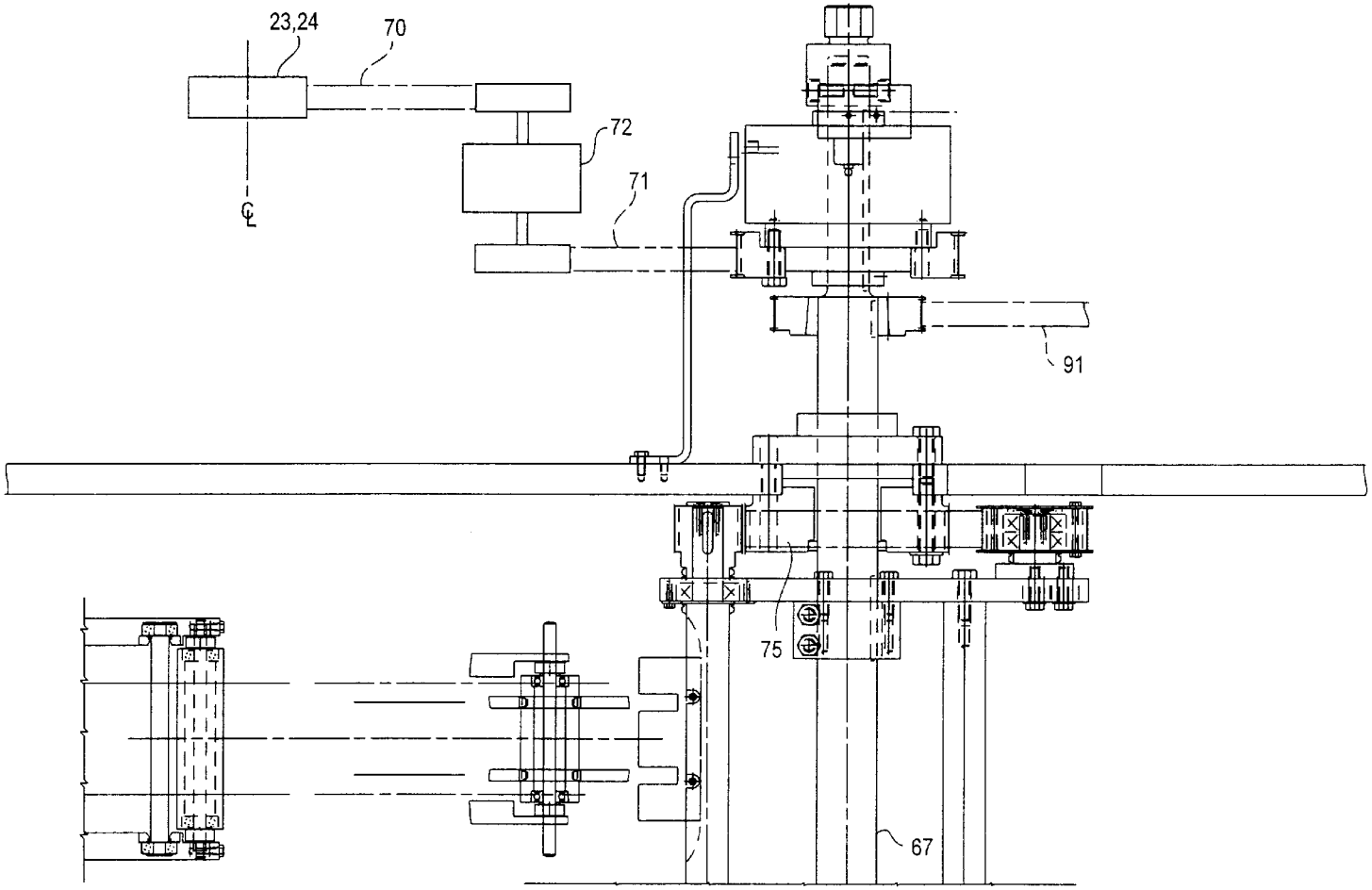
FIG. 13 is a view similar to FIG. 12 showing an alternative drive system for the tucker.

Alternatively, as illustrated in FIG. 13, the rotary shaft 67 can be mechanically driven by the cutoff rolls 23 and 24 through belts 70 and 71 and a phaser 72. The phaser is used to adjust the movement of the tucker assembly so that the tucker assembly engages the desired portion of the product which is to be folded.

A rotatable pulley 73 is rotatably mounted on the left end of the rotary arms 66 and carries a flat tucker blade 74. A fixed timing pulley 75 is ensleeved over the rotary shaft 67 but does not rotate with the shaft. A rotatable pulley 76 is mounted on the right end of the rotary arms 66. A timing belt 77 extends around the pulleys 73, 75, and 76.

As the rotary shaft rotates, the rotary arms 66 and the pulley 73 orbit around the fixed timing pulley 75. The tip of the tucker blade then traces a hypocycloidal path indicated by the three peaks 78, 79, and 80 in FIGS. 2 and 8.

In one specific embodiment the drive ratio of the fixed pulley 75 to the orbiting pulley 69 was 3:1 and the blade to pivot ratio was 2:1. Other ratios will also work. The distance from the tip of the tucker blade to its pivot was 1.625 inches, and the radius of the orbit arm was 3.25 inches. These ratios work well with web speeds in excess of 500 feet per minute. Other sizes would also work with the same ratio.

The right and left V-belts 29 and 30 transfer the cut-to-length products downwardly from the cutoff rolls to the hypocycloidal tucker assembly 31. The belts grip each product inwardly of the side edges to provide clearance for horizontal belts which will be described hereinafter. The tucker blade 70 is provided with notches 81 (FIG. 12) along the length thereof to provide clearance for the V-belts, two belts for each lane of product.

Figure 10A:
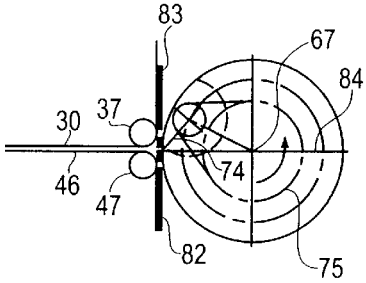
FIGS. 10A through 10L illustrate the hypocycloidal movement of the tucker for initiating a transverse fold in a product.
Figure 10B:
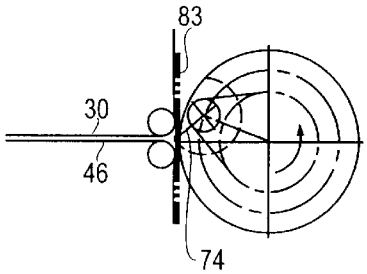
Figure 10C:
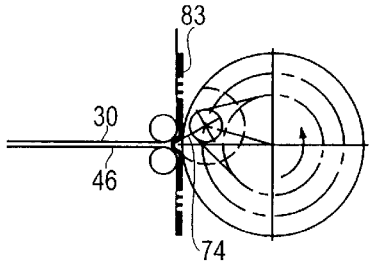
Figure 10D:
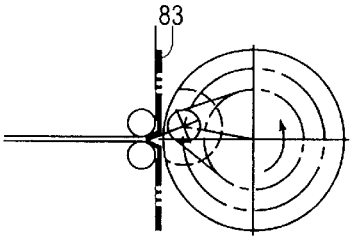
Figure 10E:
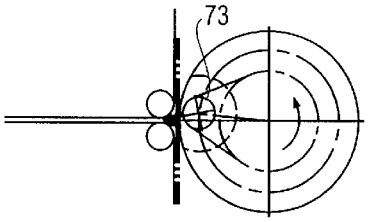
Figure 10F:
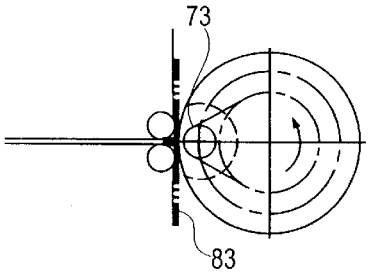
Figure 10G:
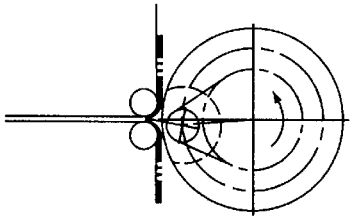
Figure 10H:
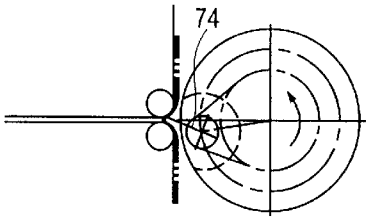
Figure 10I:
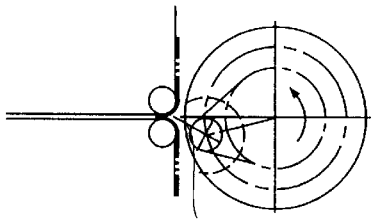
Figure 10J:
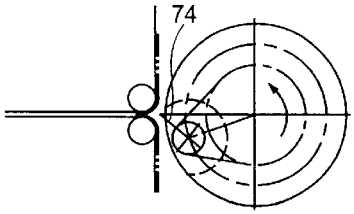
Figure 10K:
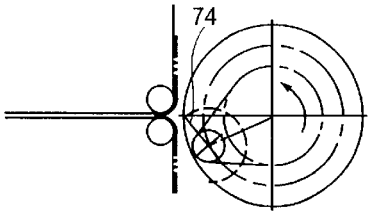
Figure 10L:
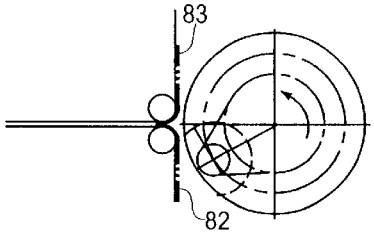
Figure 11A:
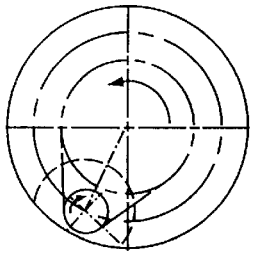
FIGS. 11A through 11L illustrates the motions of the rotary arm and the tucker.
Figure 11B:
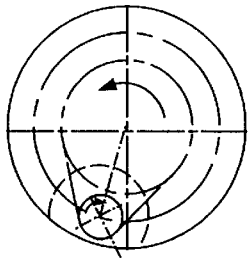
Figure 11C:
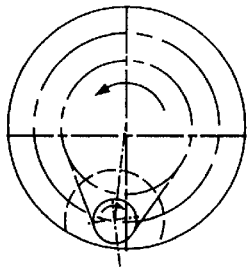
Figure 11D:
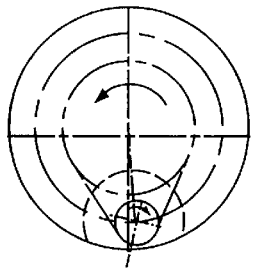
Figure 11E:
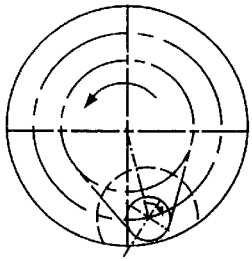
Figure 11F:
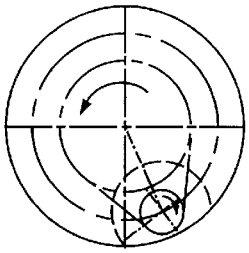
Figure 11G:
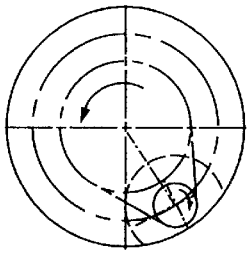
Figure 11H:
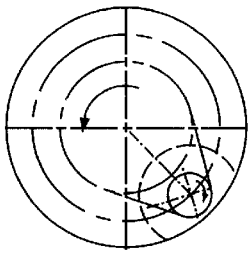
Figure 11I:
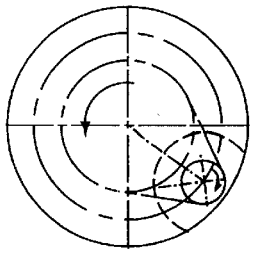
Figure 11J:
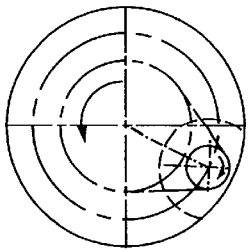
Figure 11K:
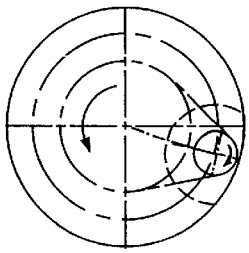
Figure 11L:
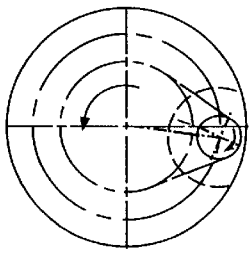

Referring to FIG. 8 and 10A, the leading end 82 of each cut-to-length product 83 is conveyed by the belts 29, 30 and 51 past the horizontal plane 84 through the axis of the rotary shaft 62 of the tucker assembly and past the nip between the belts 30 and 46 which travel over rollers 37 and 47. The downwardly extending V-belts 29 ensure that the leading end of the product moves past the tucker position. This controls the crossfold registration. If the V-belts 29 did not extend past the tucker position, some products, particularly wet products, might turn left at the tucker position and enter the nip between belts 30 and 46.

FIG. 10A illustrates the position of the product 83 and the tucker blade 74 just prior to the tucker blade contacting the product. As the rotary arms 66 of the tucker assembly continue to rotate counterclockwise, the tucker blade 74 engages the product and pushes the product into the nip between the belts 30 and 46 (FIGS. 10B–10F).

In the embodiment illustrated, the tucker blade 74 contacts the center of the length of the product in order to fold the product in half. However, the tucker can be adjusted to make the fold in any desired location. The tucker can also be adjusted to engage the leading end of the product in order to change the product direction without folding the product.

The rotary tucker shaft 67 is rotated one revolution per product by the tucker drive. For a single product size this can be a mechanical drive in time with the cutoff rolls. For a totally automated process the tucker, the cutoff roll, and packer (to be described hereinafter) can be servo driven. When separately driven, the velocity of the rotary tucker shaft is controllable such that it can make one revolution for each product. The speed can be cycled faster or slower during periods of the revolution to allow. the tucker blade velocity to be near match to the web velocity in a perpendicular direction. The desirable velocity of the tip of the tucker blade would be about web speed at the point of contact, the tip velocity then decelerates at the end of the hypocycloidal motion.

The folded product is tucked into the horizontal belts 30, 46 at a match speed to the horizontal belt speed. This creates the transverse fold on the product. The tucker's flat blade tip follows a hypocycloidal path and moves the product from the vertical belt path into the horizontal belt nip. It then rapidly decelerates to a stop at the end of its path (FIG. 10F), then moves back out and cycles around for the next product (FIGS. 10F–10L). The tucker drive utilizes timing belts, but the drive could also be accomplished with gears.

Figure 2:
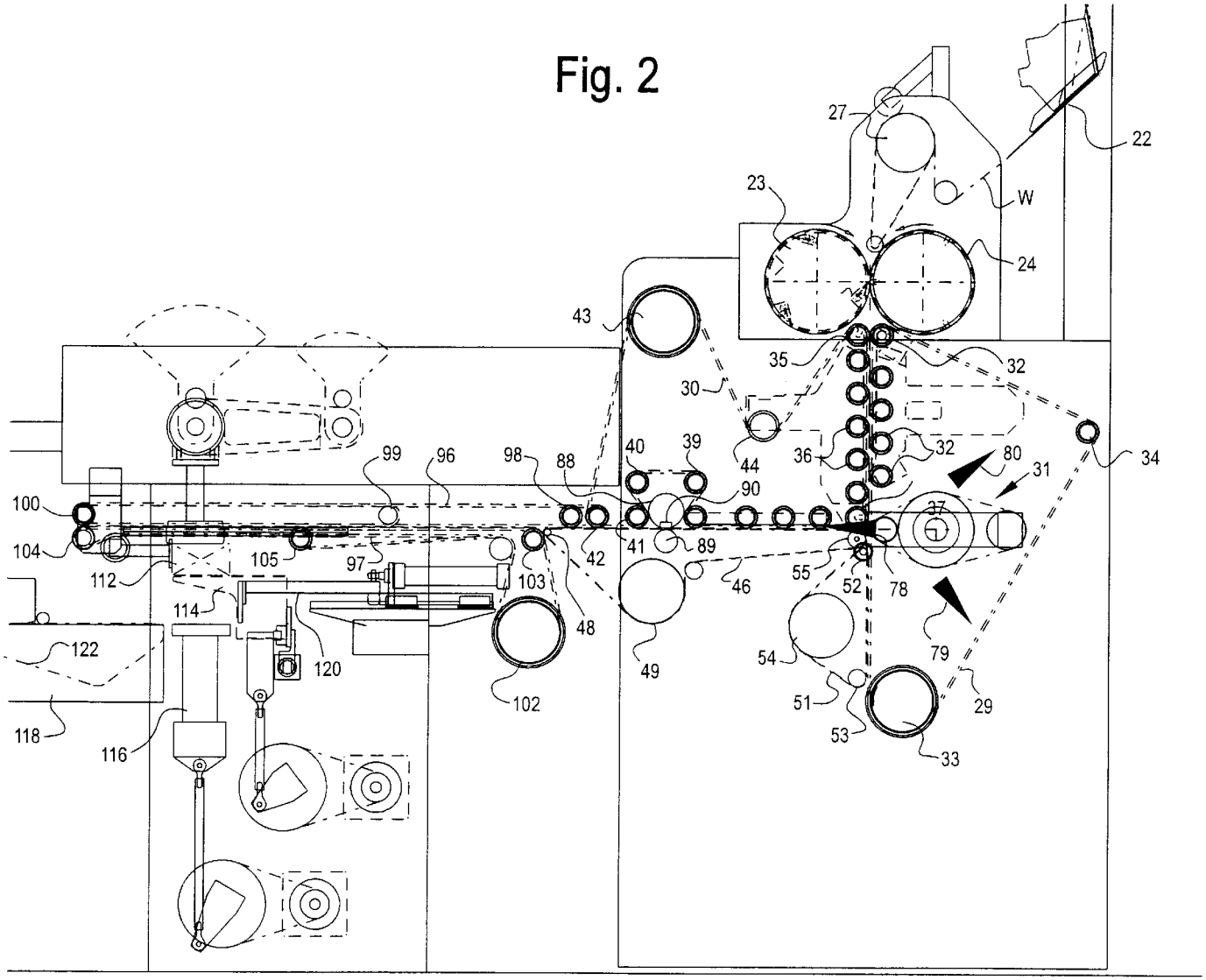
FIG. 2 is an enlarged fragmentary view of a portion of FIG. 1.

Referring to FIG. 2, the folded product is advanced horizontally to the left by the belts 30 and 46 toward a creaser roll 88 and a backup roll 89. A pad 90 is carried by the creaser roll and extends radially outwardly beyond the surface of the creaser roll.

The creaser roll is rotated by a suitable drive mechanism. For example, in FIG. 12 the creaser roll is driven by the rotary shaft 67 through belt 91. The shaft 67 is driven by servo 68. In FIG. 13 the creaser is also driven by the rotary shaft 67 through belt 91, but the shaft 67 is mechanically driven by the cutoff rolls. The drive for the creaser roll is timed so that the pad 90 engages the leading edge of the fold and presses the leading edge against the backup roll 89. Since the pad 90 engages only the leading edge of the folded product, the amount of fluid which is pressed out of wet product is limited, and into the center of the product.

The creaser roll 88 extends axially cross all of the lanes of product. The upper belt 34 is therefore diverted around the creaser roll by rollers 45 and 46 so that the belts do not engage the creaser roll.

The creased and folded product is transferred to horizontally extending upper and lower stacker infeed belts 96 and 97. The stacker infeed belts lightly grip the outside edges of the product laterally outwardly of the upper V-belt 30. The right end of the upper belt 96 can therefore travel around a roller which is axially aligned with the roller 42 for the belt 30. The belt 96 also travels over rollers 98, 99, and 100.

The lower stacker infeed belt 97 travels around driven roller 102 and roller 103, 104, and 105.

The product is conveyed by the stacker infeed belts 96 and 97 to a stacker station which includes a conventional rotary packer 110. The rotary packer makes one revolution per product. As the product reaches the stacker station, the rotary packer is moving downward. The packer makes contact with the folded and tucked product which is held by the horizontal belts 96 and 97 just as the product reaches the stacker station. The packer pushes the product from the belts onto a stack. The packer only needs to push the product through the belts, releasing it into the stack 112. The distance of travel needs to be only about one inch, or just enough to release the product from the belts 96 and 97. A servo controls the count in the stack by driving count fingers 114 in between stacks. An elevator 116 lowers the full stack to a table 118, and a pneumatic pusher 120 or servo driven belt moves the stack onto a collator conveyor belt 122.

The folding apparatus can provide a wide range of cutoff lengths by using a cutoff roll 23 with one, two, three, or more cutoff knives 25. For example, a two-time cutoff roll can provide a 9 to 13 inch cutoff range. A one-time cutoff roll can provide an 18 to 26 inch cutoff range.

The tucker assembly, which rotates three revolutions for every revolution of cutoff, would also be adjusted to make one tuck for each product. The stacker would also be modified for the longer products by adjusting the packer length, stop, count fingers, elevator, and pusher stroke. For any type of cutoff roll the apparatus can provide infinite adjustment of the cut length by rotating the cutoff rolls 24 and 26 faster or slower than web speed. The speed of the tucker will also be changed so that the product is tucked at the desired location.

It is possible to incorporate additional tucker stations to provide additional folds such as "C", "Z", "W", or combinations thereof.

Figure 14:
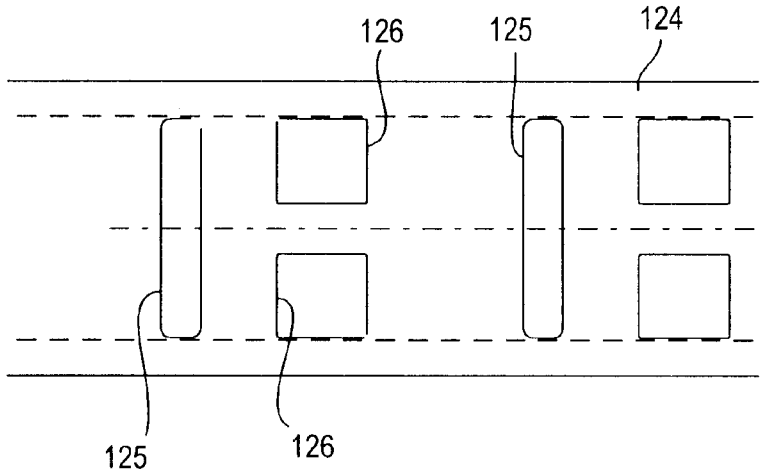
FIG. 14 is a fragmentary view of an alternative timing belt.

FIG. 14 illustrates a modified timing belt 124 which can be used instead of the V-belts. A timing belt can be wrapped around each of the cutoff roll and anvil roll to carry the product vertically downwardly from the cutoff roll. Each belt is provided with notches 125 for the cutoff blades and notches 126 for the hypocycloidal tucker blade. The timing belt also eliminates the need for the comb shells 28 and 29.

Alternatively, a timing belt 124 could be used with only one of the cutoff and anvil rolls, and V-belts could be used below the other roll as previously described.

When the folding apparatus is started, the tucker assembly can be disengaged, for example, by disengaging a clutch for the drive to the rotary shaft 67. The scrap or cull products which are cut by the cutoff rolls 23 and 24 are then conveyed downwardly by the belts 29, 30, and 51 past the tucker assembly where they can be discharged from the folding apparatus.

While in the foregoing specification a detailed description of specific embodiments were set forth for the purpose of illustration, it will be understood that many of the details hereingiven may be varied considerably by those skilled in the art without departing from the spirit and scope of the invention.

We claim:

1. A transverse folding apparatus comprising:

a frame, a feed roll rotatably mounted on the frame for feeding a web, an anvil roll rotatably mounted on the frame, a cutoff roll rotatably mounted on the frame adjacent the anvil roll, at least one cutoff knife on the cutoff roll engageable with the anvil roll for cutting a web between the cutoff roll and the anvil roll, and first and second belts for conveying a cut web product from the cutoff and anvil rolls along a first web path, the second belt extending along the first web path and along a second web path which extends transversely from the first web path, the first belt extending along the first web path beyond the second web path.

2. The apparatus of claim 1 including a rotatable tucker blade mounted on the frame for movement along a rotary path, a portion of the path extending transversely past the first belt into the first web path for transversely folding a cut web product in the first web path into the second web path.

3. The apparatus of claim 2 in which said tucker blade is mounted for movement along a hypocycloidal path having a plurality of peaks, one of the peaks extending transversely past the first belt into the first web path for transversely folding a cut web product in the first web path into the second web path.

4. The apparatus of claim 2 in which the tucker blade is provided with a notch which is aligned with the first belt, the first belt being positioned in the notch as the tucker blade moves into the first web path.

5. The apparatus of claim 2 including a rotary shaft mounted on the frame for moving said tucker blade along a rotary path, and means for rotating the rotary shaft 360° each time a cutoff knife on the cutoff roll engages the anvil roll.

6. The apparatus of claim 5 in which said tucker blade is mounted for movement along a hypocycloidal path having a plurality of peaks, one of the peaks extending transversely past the first belt into the first web path for transversely folding a cut web product in the first web path into the second web path.

7. The apparatus of claim 5 including a creasing roll rotatably mounted on the frame adjacent the second web path, the creasing roller including a radially outwardly extending pad for engaging a folded edge of a web product in the second web path.

8. The apparatus of claim 1 including a first shell mounted on the cutoff roll and a second shell mounted on the anvil roll, each of the shells including radially outwardly extending ridges and valleys between the ridges whereby a web between the cutoff and anvil rolls is squeezed by the ridges of the shells.

9. The apparatus of claim 1 including a creasing roll rotatably mounted on the frame adjacent the second web path, the creasing roller including a radially outwardly extending pad for engaging a folded edge of a web product in the second web path.

10. The apparatus of claim 9 including means for rotating the creasing roller 360° for each cut web product passing the creasing roller so that the pad engages a folded edge of each cut web product.

11. The apparatus of claim 9 including rollers mounted on the frame for diverting the second belt around the creasing roller.

12. The apparatus of claim 1 in which said second belt includes a pair of spaced-apart belt loops, a pair of belt frames mounted on said frame, a first removable roller engaging the belt loops along the first web path adjacent the cutoff and anvil rolls, a second removable roller engaging the belt loops at the intersection of the first and second web paths, the belt loops extending around the second roller from the first web path to the second web path, the first and second rollers being removably mounted in slots in the belt frames.

13. The apparatus of claim 12 including at least one idler roll rotatably mounted on each of the belt frames between the first and second removable rollers.

14. The apparatus of claim 12 including a pivoting roller pivotably mounted on the frame and engaging said belt loops, the pivoting roller being pivotable between a first position in which the pivoting roller tensions the belt loops to retain the first and second removable rollers in the slots in the belt frames and a second position in which the tension on the belt loops is relaxed and the first and second removable rollers can be removed from the slots in the belt frames.

15. The apparatus of claim 1 in which the first web path extends vertically downwardly from the cutoff and anvil rolls and the second web path extends horizontally from the first web path.

16. The apparatus of claim 1 including first and second feed belts aligned with the second web path for conveying a folded cut web product from said second belt, and second belt being positioned between the first and second feed belts.

17. The apparatus of claim 1 including means for rotating the cutoff and the anvil rolls and the first and second belts at a different speed than the feed roll whereby the length of web products cut by the cutoff and anvil rolls can be varied.

18. The apparatus of claim 1 including means for rotating the cutoff and anvil rolls at a different speed than the feed roll and the first and second belts whereby the length of web products cut by the cutoff and anvil rolls can be varied.

* * * * *